US010004338B2

(12) United States Patent
Ha et al.

(10) Patent No.: US 10,004,338 B2
(45) Date of Patent: Jun. 26, 2018

(54) CHAIR EQUIPPED WITH SUPPORTER FOR SHOULDER

(71) Applicants: Jeong rok Ha, Gyeonggi-do (KR); Myung Suk Namgung, Gyeonggi-do (KR)

(72) Inventors: Jeong rok Ha, Gyeonggi-do (KR); Myung Suk Namgung, Gyeonggi-do (KR)

( * ) Notice: Subject to any disclaimer, the term of this patent is extended or adjusted under 35 U.S.C. 154(b) by 0 days. days.

(21) Appl. No.: 14/886,043

(22) Filed: Oct. 17, 2015

(65) Prior Publication Data

US 2017/0099952 A1 Apr. 13, 2017

(30) Foreign Application Priority Data

Apr. 28, 2015 (KR) ..... 10-2015-0059933

(51) Int. Cl.

| | |
|---|---|
| ***A47C 7/54*** | (2006.01) |
| ***A47C 3/30*** | (2006.01) |
| ***A47C 7/00*** | (2006.01) |
| ***A47C 7/38*** | (2006.01) |
| ***A47C 7/40*** | (2006.01) |
| ***A47C 1/03*** | (2006.01) |

(52) U.S. Cl.

CPC ..... *A47C 7/543* (2013.01); *A47C 1/03* (2013.01); *A47C 3/30* (2013.01); *A47C 7/004* (2013.01); *A47C 7/006* (2013.01); *A47C 7/38* (2013.01); *A47C 7/405* (2013.01)

(58) Field of Classification Search

CPC .. A47C 7/54; A47C 7/543; A47C 3/30; A47C 7/004; A47C 7/006; A47C 7/38; A47C 7/405

See application file for complete search history.

(56) References Cited

U.S. PATENT DOCUMENTS 4,565,409 A * 1/1986 Hollonbeck ..... A47C 16/00 297/411.1
5,536,070 A * 7/1996 Lemmen ..... A61G 5/125 297/411.36

(Continued)

FOREIGN PATENT DOCUMENTS

KR 20-0270421 3/2002
KR 10-2010-0089001 8/2010

(Continued)

*Primary Examiner* — Philip F Gabler

(74) *Attorney, Agent, or Firm* — KORUS Patent, LLC; Seong Il Jeong

(57) ABSTRACT

A chair equipped with shoulder supporter is provided. The chair equipped with shoulder supporter can obtain an effect of attitude remedy by reducing the pressure applied to the spine and by inducing an upright attitude of erecting the waist vertically through a shoulder supporter which is connected to a hip supporter through a base. The shoulder supporter comprises an armpit supporter provided above a vertical supporter. The chair equipped with shoulder supporter can maximize convenience and enable the multi-purpose use by selecting the use and non-use of the arm supporter or the shoulder supporter with the direction change through up-down or forward-rearward direction rotation of the arm supporter or with the folding of the armpit supporter through a rotation shaft.

4 Claims, 4 Drawing Sheets

(56) References Cited

U.S. PATENT DOCUMENTS

| | | | | |
|---|---|---|---|---|
| 5,927,815 | A * | 7/1999 | Nakamura | F16C 11/106 248/276.1 |
| 6,619,747 | B2 * | 9/2003 | Ko | A47C 7/54 248/118.3 |
| 6,773,071 | B1 * | 8/2004 | Stasney | A47C 7/546 248/118.3 |
| 9,282,826 | B1 * | 3/2016 | Hickman | A47C 7/62 |
| 2009/0278391 | A1 * | 11/2009 | Ulrich | A47C 7/443 297/283.1 |

FOREIGN PATENT DOCUMENTS

| | | |
|---|---|---|
| KR | 10-2012-0000763 | 1/2012 |
| KR | 10-2013-0141827 | 12/2013 |

* cited by examiner

CHAIR EQUIPPED WITH SUPPORTER FOR SHOULDER

BACKGROUND (a) Technical Field

The present invention relates to a chair equipped with supporter for shoulder, and more particularly, it relates to a chair equipped with supporter for shoulder which can obtain an effect of attitude remedy by reducing the pressure applied to the spine and by inducing an upright attitude of erecting the waist vertically through the supporter for shoulder which is connected to the hip supporter through the base and which comprises the supporter for armpit provided above the supporter, in addition, which can maximize the effect of attitude remedy by solving the problems of inconvenience or avoidance by distributing the load so as to reduce the tired feeling which inevitably occurs in case of leaning on the supporter for shoulder through the supporter for arm provided below, and in particular, below at the outside of the supporter for armpit for long time, and furthermore, which can maximize convenience and enable the multi-purpose use by selecting the use and non-use of the supporter for arm or the supporter for shoulder through the direction change through up-down or forward-rearward direction rotation of the supporter for arm or through the folding of the supporter for armpit of the supporter for shoulder through the rotation shaft.

(b) Background Art

In general, the spine disk patient, the handicapped person, the children and the student have difficulty in sitting at the chair in a regular attitude in a conventional chair so that various special chairs have been suggested.

There is a laid-open patent 10-2013-0141827 the title of which is "an auxiliary back supporter removably attached to a chair" as a technology related to the special chair.

This prior art technology suggests the auxiliary back supporter removably attached to a chair which has a mounting stand which can be mounted on a back supporter of the chair, wherein a pair of support plates which are separated to left and right sides are formed in front of the mounting stand so as to support the back of the user, the one pair of support plates are combined with each mounting stand so as to support the back of the user to suit the body shape by the elastic action of the elastic means so as to maintain the correct attitude to suit the body shape of the user even at the conventional chair and support the back of the user regardless of the body condition of the user or the angle of the leaning.

However, the above prior art technology relates to the auxiliary back supporter provided at the chair to remedy the attitude of the user and has a problem in that the person such as the spinal disk patient who has difficulty in seating in regular attitude can be biased forward so as to cause an accident of falling down.

In addition, there is a registered utility 20-0270421 the title of which is "a chair for remedying the spine" as a prior art technology.

This prior art technology suggests the chair for remedying the spine in which a pair of vertical through holes parallel to each other are formed at the back supporter, an air spring erected vertically the lower end of which is supported at the left plate and a height adjustment means constituted by a transverse supporter to both ends of which combination tools are provided and fixed are mounted at the upper end of the air spring, and the end of supporter frame supporting the spine supporter below both ends of which the supporter of arm pits are provided ate fixed at each combination tool.

However, the above prior art technology also does not have a device which supports the breasts but fixes by supporting only both armpits, and has a problem in that in case the user is biased forward, it can cause an accident of falling down.

Furthermore, there is a laid-open patent 10-2012-0000763 the title of which is "a system of activating the blood circulation and building up a habit of regular attitude".

This prior art technology relates to the system of activating the blood circulation and building up a habit of regular attitude in which the activity of the brain becomes vigorous so as not to be sleepy and increase the ability to concentrate by making the blood circulation of the physical body smooth under the condition of sitting at the chair and making mentally comfortable so as to relieve the stress and tiredness and building up a habit of correct attitude in daily life, and in particular, suggests a technology comprising a jacket which is put on the upper body of the user, a longitudinal belt section which is sewed to the jacket in longitudinal direction and supporting the load of the physical body, and a transverse belt section which is fixed to the shoulder section of the jacket and is connected to the longitudinal belt section and is sewed to the upper breast-tie supporting the load upward and the jacket in transverse direction and adjusts the pressure strength of the upper body by having at least one selected from Velcro, button and buckle, so as to present effects of activating the blood circulation and promoting the recovery from tiredness and preventing the sleepiness and raising the concentration and judgment under the condition of mental peace while sitting on the chair regardless of time and place, and of rapidly processing the reflex motion and the rapid connection motion by making the motion of waist smooth by distributing the weight of the upper half body concentrated on the waist, and of protecting the health and preventing the trivial diseases by building up the habit of correct attitude easily alone without the aid of others with small cost.

However, the above prior art technology remedies the attitude of the user by wearing the jacket and fixing it through the upper part and the fixing section of the installation place, and can have problems in that separate fixing means shall be provided since it is of the manner of fixing to the chair, vehicle or the like through the fixing section, and it can cause inconvenience according to the wearing of the jacket, and cannot present stable feeling due to loosening or tightness according to the physical constitution.

In addition, there is a laid-open patent 10-2010-0089001 the title of which is "a chair and a chair auxiliary tool" as a prior art technology.

This prior art technology suggests a chair comprising an auxiliary supporter for head/back, a head supporting means attached to the auxiliary supporter for head/back, and an arm supporting means attached to the auxiliary supporter for head/back, so as to maintain the head and back in a correct attitude in case of raising the head/back upright or lowering the head/back.

However, the prior art technology is to remedy and fix the attitude of the spine disk patient, and has an effect of correcting the attitude, however, has a problem in that the cost is increased due to the complication of the structure and it does not support the waist entirely but only supports the shoulder so that the user feels inconvenience.

SUMMARY OF THE DISCLOSURE

Therefore, an object of the present invention is to provide a chair equipped with supporter for shoulder which can obtain an effect of attitude remedy by reducing the pressure applied to the spine and by inducing an upright attitude of erecting the waist vertically through the supporter for shoulder which is connected to the hip supporter through the base and which comprises the supporter for armpit provided above the supporter, and in addition, which can maximize the effect of attitude remedy by solving the problems of inconvenience or avoidance by distributing the load so as to reduce the tired feeling which inevitably occurs in case of leaning on the supporter for shoulder through the supporter for arm provided below, and in particular, below at the outside of the supporter for armpit for long time.

Furthermore, other object of the present invention is to provide a chair equipped with supporter for shoulder which can maximize convenience and enable the multi-purpose use by selecting the use and non-use of the supporter for arm or the supporter for shoulder through the direction change through up-down or forward-rearward direction rotation of the supporter for arm or through the folding of the supporter for armpit of the supporter for shoulder through the rotation shaft.

To accomplish the above objects, a chair equipped with supporter for shoulder comprises:

a base;

a hip supporter provided above the base; a supporter for shoulder comprising a supporter connected to the base and protruding to both sides of the hip supporter, and a supporter for armpit provided above the supporter; and a supporter for arm connected to the base and provided below the supporter for armpit.

In the chair equipped with supporter for shoulder according to the present invention, the supporter for arm is combined to the supporter of the supporter for shoulder and arranged at the outside below the supporter for armpit, the supporter for arm is connected to the supporter of the supporter for shoulder through an up-down direction rotational first connection shaft so as to be foldable, the supporter for arm is connected to the supporter of the supporter for shoulder through a forward-rearward direction rotational second connection shaft so as to be able to be converted in its direction from forward to lateral, and the supporter for armpit of the supporter for shoulder is connected to the supporter through a rotational shaft so as to be foldable.

(Effect of the Present Invention)

The chair equipped with supporter for shoulder according to the present invention can obtain an effect of attitude remedy by reducing the pressure applied to the spine and by inducing an upright attitude of erecting the waist vertically through the supporter for shoulder which is connected to the hip supporter through the base and which comprises the supporter for armpit provided above the supporter, in addition, can maximize the effect of attitude remedy by solving the problems of inconvenience or avoidance by distributing the load so as to reduce the tired feeling which inevitably occurs in case of leaning on the supporter for shoulder through the supporter for arm provided below, and in particular, below at the outside of the supporter for armpit for long time, and furthermore, can maximize convenience and enable the multi-purpose use by selecting the use and non-use of the supporter for arm or the supporter for shoulder through the direction change through up-down or forward-rearward direction rotation of the supporter for arm or through the folding of the supporter for armpit of the supporter for shoulder through the rotation shaft.

DETAILED DESCRIPTION

The present invention will be described in detail with reference to the accompanying drawings.

The present invention can be applied with various changes and can have various shapes, and accordingly the aspects (or embodiments) will be described in detail in the present text. However, this shall be understood not to limit the present invention to the particular disclosure, but to include all changes, equivalents and substitutions included in the thoughts and technical scope of the present invention.

The identical reference numbers in each drawing, in particular, a number of ten and a number of one, or the reference numbers identical in a number of ten and a number of one and the alphabet shall be understood to represent the member having the same or similar function, and in case where there is no special statement, the member to which each reference number refers is the member following this standard.

In addition, the constitutional elements in each drawing represent the size or the thickness exaggeratedly large (or thick) or small (or thin) or represent by simplifying in consideration of convenience of understanding, however, the scope of protection of the present invention shall not be interpreted restrictively by the above matter.

The terminologies used in the present specification is used only to explain the particular aspect (or embodiment), but is not intended to limit the present invention. The expression of singular number includes the expression of plural number unless otherwise mean obviously in the context. In the present application, the terminologies of "comprise" or "consists of" or the like shall be understood to indicate the existence of characteristic, number, step, action, structural element, part or combination of these, but not to exclude in advance the possibility of existence or addition of characteristic, number, step, action, structural element, part or combination of these.

Unless defined otherwise, all terminologies used herein including the technical or scientific terminologies have the meaning identical to those generally understood by those skilled in the art. The terminologies such as those defined in the dictionary generally used shall be interpreted to have the identical meaning consistent to those meant in the context of the present application, but shall not be interpreted to be the meaning ideal or expressively formal unless obviously defined in the present application.

In case where the specific explanation of the well-known function and structure in the present specification is judged to unnecessarily make the gist of the present invention obscure, the explanation of those can be omitted.

The terminologies "first", "second" and the like described in the present application are only used to discriminate elements different from each other, but are not limited to the order of manufacture, and can disagree with each other in the detailed description and the claims of the present invention.

Figure 1:
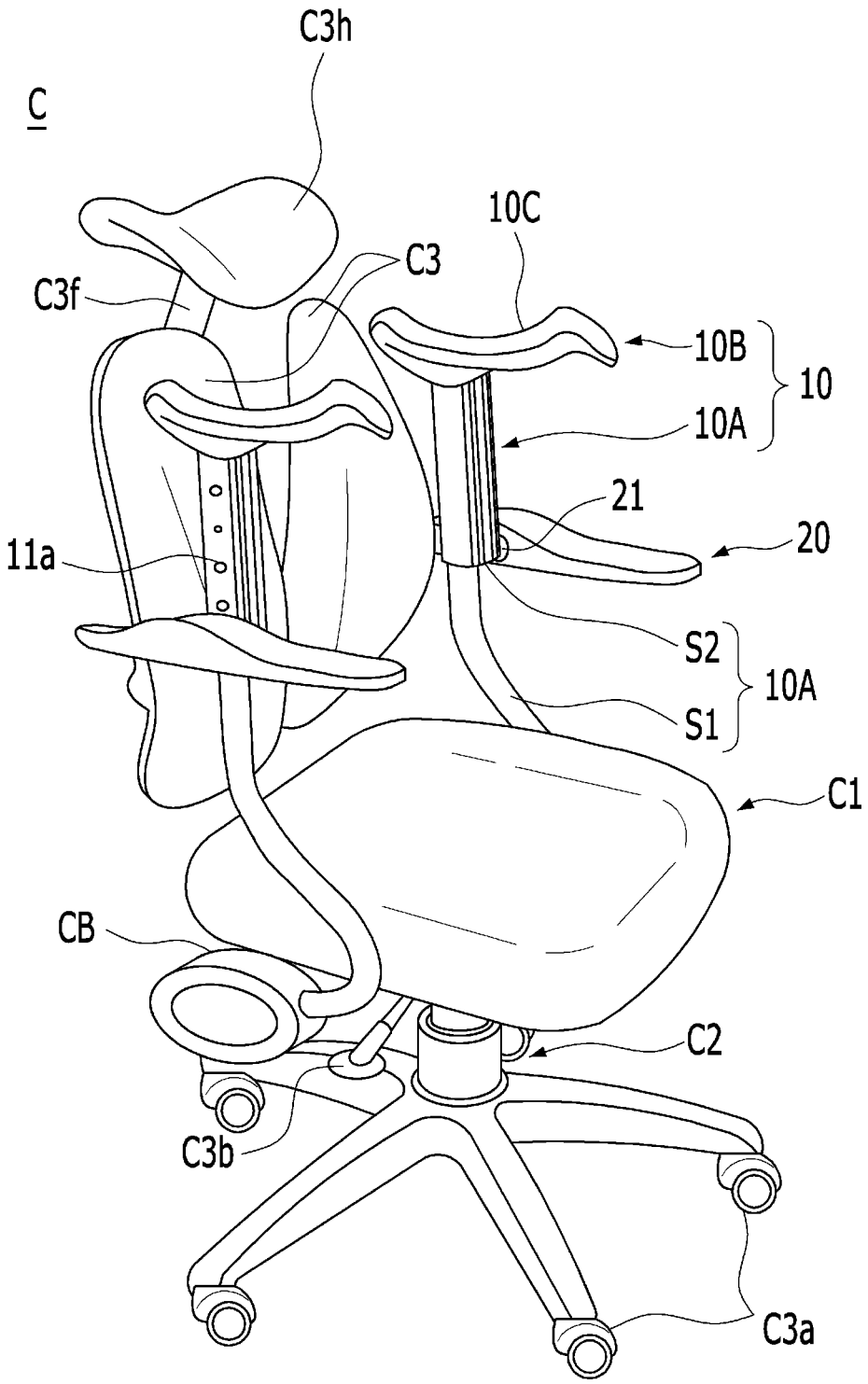
FIG. 1 is a perspective view of a chair equipped with supporter for shoulder according to the present invention.
Figure 2:
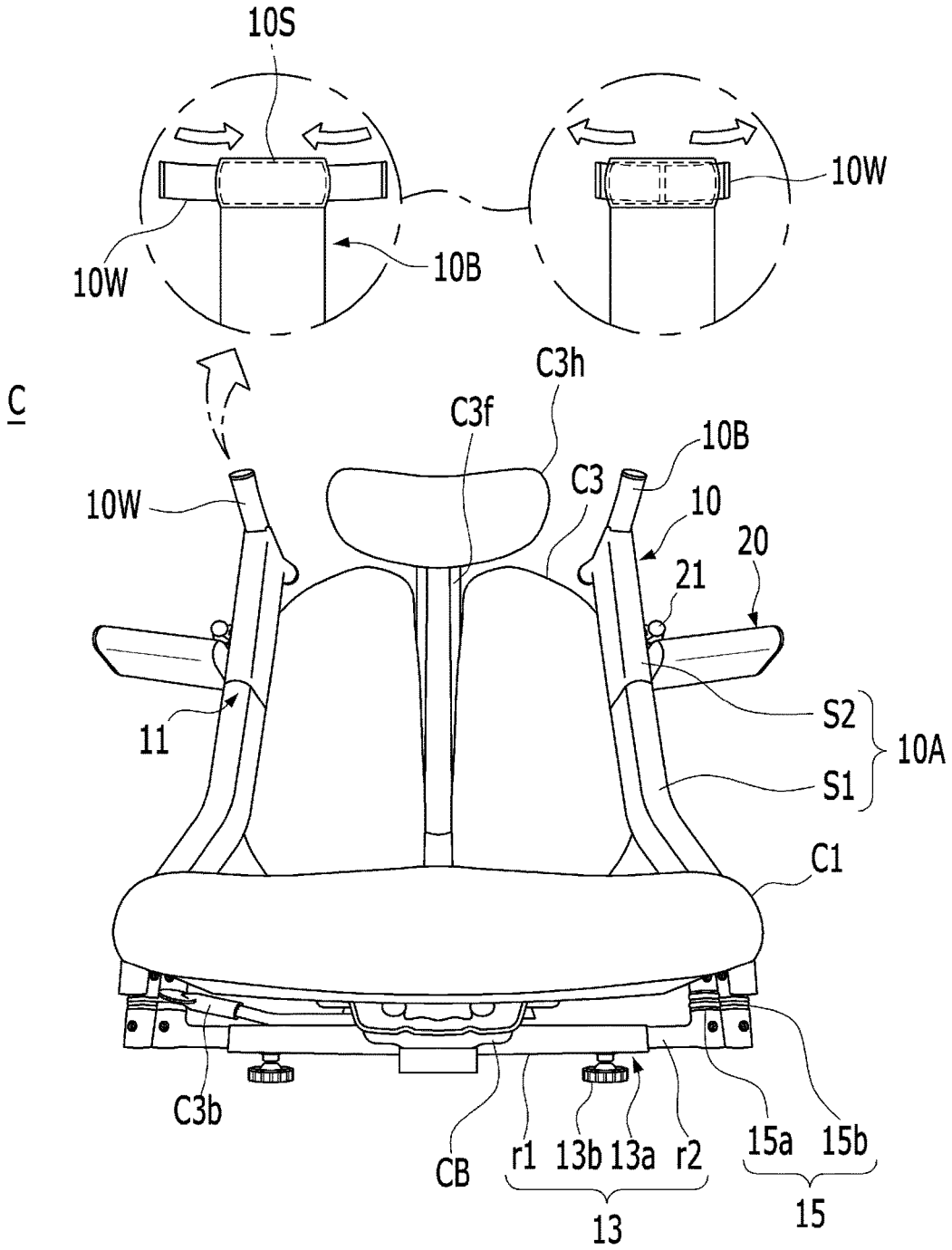
FIGS. 2 to 4 are drawings showing changes of the chair equipped with supporter for shoulder according to the present invention.

Specifying the approximate and not strict reference of direction for convenience of description of the chair equipped with supporter for shoulder C according to the present invention with reference to FIGS. 1 and 2, the up and down, left and right, and forward and rearward are divided in the condition of as shown, and in particular, the direction is specified in view of the user sitting on the chair, and the direction will be specified according to this reference unless otherwise mentioned in the detail description and the claims of the present invention.

Figure 3:
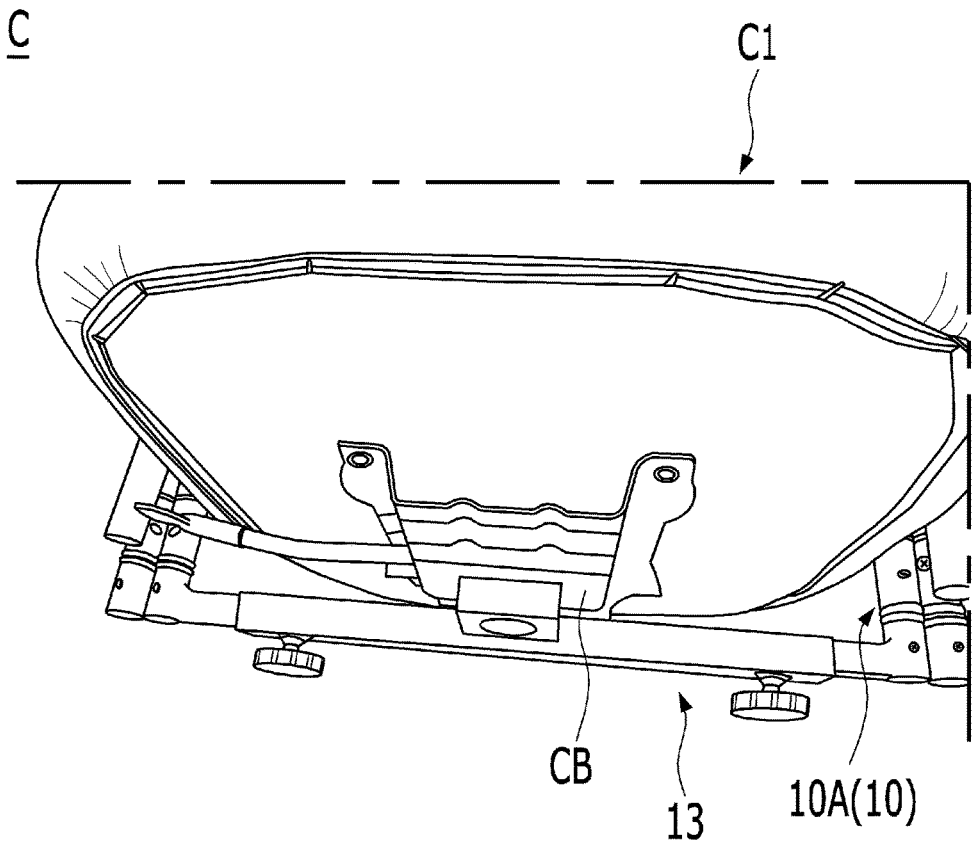

First, as shown in the first embodiment of FIG. 1 and the changed second embodiment of FIGS. 2 and 3, a chair equipped with supporter for shoulder C according to the present invention comprises:

a hip supporter C1 on a base CB with the base as a center; and a supporter for shoulder 10 and a supporter for arm 20 consisting the gist of the present invention.

In addition, the chair equipped with supporter for shoulder C, as shown in FIG. 1, comprises a main supporter C2 which has a structure such as a gas repeater and a pneumatic cylinder and of which the height is adjustable according to the operation of a height adjustment lever C3*b*, and a caster type moving wheel C3*a* can be provided at each end of a supporter connected to the main supporter in a radial form.

Furthermore, a frame C3*f* also connected to the base CB (support panel structure and the like below the hip supporter C1, refer to FIG. 3) can have a back supporter C3 as well as a head supporter C3*f* also connected to the upper part of the frame.

The chair equipped with supporter for shoulder C according to the present invention can be a chair for office or study provided on the main supporter C2 as shown in FIG. 1, or a sitting-on-floor type auxiliary chair of which main supporter or moving wheel is omitted.

In addition, the chair equipped with supporter for shoulder C according to the present invention can be used as a chair having simple structure simply having only the supporter for shoulder and supporter for arm with the back supporter or the head supporter or both of them being omitted.

A cushion function can be introduced to the hip supporter C1, a supporter for armpit 10B of the supporter for shoulder 10, the supporter for arm 20 and other supporter 10A by using sponge, polyurethane foam and other cushion material.

As shown in FIGS. 1 and 2, the supporter for shoulder 10 comprises a supporter 10A which is connected to the base CB and protrudes to both sides of the hip supporter C1, and the supporter for armpit 10B provided on the supporter 10A.

In addition, it is preferred that the supporter 10A can be adjusted to suit the body structure of the user by having the height adjustment function, and the supporter 10A has a multi-step structure such as a first supporter S1 connected to the base CB and a second supporter S2 on the first supporter, and mutually insertion combined so as to adjust the length of the superposed interval of a telescopic type so that the height adjustment of the first supporter and the second supporter is carried out, and the height adjusted condition can be fixed through a fixing lever 11*a* provided with bolts and the like.

In addition, the supporter 10A and especially the supporter for armpit 10B provided on the second supporter S2 preferably improve seating feeling and wearing feeling by having a cushion body 10C (refer to FIG. 1).

This supporter for armpit 10B preferably supports the armpit as long and wide as possible by further protruding forward and rearward than the supporter 10A.

As an additional change shown in the one-dot chain line circle in the upper part of FIG. 2, a protruding wing 10W is housed into an inner space 10S of the supporter for armpit 10B so as to adjust the protrusion length or can be adjusted to the form of completely housed, and the protrusion degree adjustment condition can be stopped by various fixing manner.

Next, the supporter for arm 20 being one of the other core members of the present invention is also connected to the base CB and is provided below the supporter for armpit 10B.

The connection manner of the supporter for arm 20 to the base CB can be accomplished through the supporter 10A of the supporter for shoulder 10.

Figure 4:
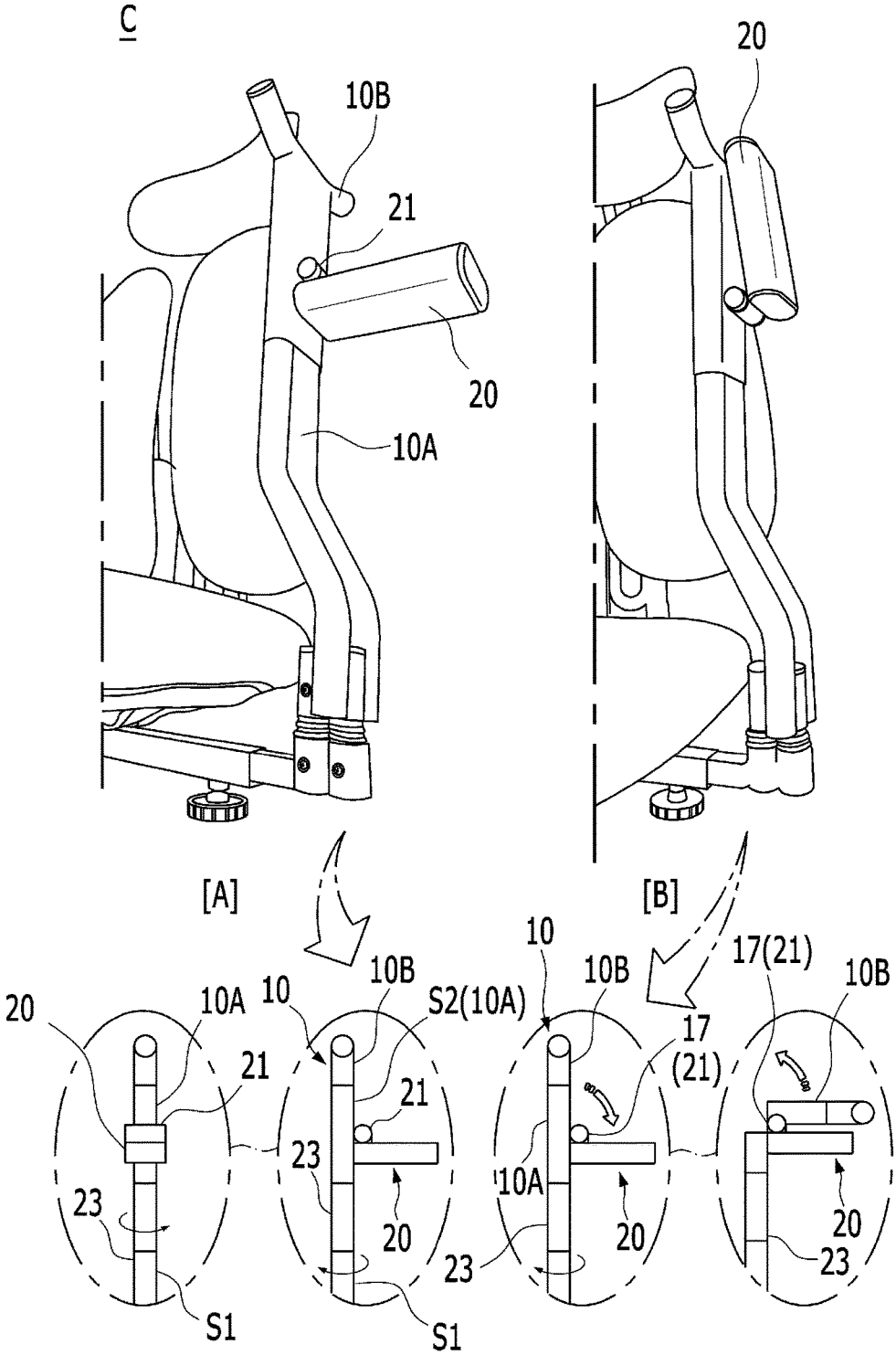

As can be confirmed in FIGS. 1 and 4, the supporter for arm 20 can be constructed so that it is combined to the second supporter S2 among the supporter 10A of the supporter for shoulder 10 so that the height can be adjusted together with the second supporter at the time of operation of a height adjustment section 11. If necessary, the supporter for arm can be constructed so as to be fixed to the first supporter or to be adjusted in its height independently.

In addition, the supporter for arm 20 can be constructed to be arranged below and at the outside of the supporter for armpit 10B so that the arm is naturally laid on the supporter for arm under the condition that the armpit portion of the shoulder is laid on the supporter for armpit.

In the change of FIGS. 2 to 4 different from FIG. 1, it is constructed in such a way that the outward protrusion degree of the supporter for arm is larger so as to be more appropriate to take various attitudes.

In the meantime, as can be confirmed in FIGS. 2 to 4, in the chair equipped with supporter for shoulder C according to the present invention, the supporter 10A is connected through a horizontal link 13 connecting the base CB (the terminology "horizontal" is not a strict meaning in the mathematics or the physics but means a structural element arranged in left right direction in contrast to supporters arranged up and down direction).

In addition, in this horizontal link, a first link r1 and a second link r2 connected to the base CB also have multi step structure and are mutually inserted and combined in a telescopic type so as to be able to adjust the length of the superposition interval, and the adjustment condition of a length adjustment section 13*a* of first and second link male-female combination type is preferably fixed by a fixing handle 13*b* so as to be easily adjusted to suit the body of the user so as to increase the seating feeling and comfort.

Furthermore, an elastic link 15 is provided between the supporter 10A of the supporter for shoulder 10 and the horizontal link 13, the action of the user moving his upper body forward-rearward and left-right can be naturally done under the condition that the user inserts supporter for armpit 10B between his armpits.

In particular, a plurality of elastic links 15 are arrange at the connection point connecting each of left and right supporters 10A and the horizontal link 13 side by side, and in consideration of the fact that the poor attitude of forward-rearward deflection of the waist is mainly corrected by the supporter for shoulder, it is preferred that on the one hand, the convenience and usability are secured by making the various forward-rearward movement while sitting at the desk to be carried out easily by making the forward-rearward deflection of the waist under the condition of simple upstanding of the spine to be carried out easily, and on the other hand, the effect of correction of the poor attitude of left-right deflection which may be insufficient only by the supporter for shoulder can be improved by restraining the left-right movement by the plural elastic links 15*a*, 15*b* arranged side by side.

Next, in the chair equipped with supporter for shoulder C according to the present invention, the supporter for arm 20 is connected to the supporter 10A through an up-down direction rotation first connection shaft 21, so that as can be confirmed in the developed condition of FIG. 4A and the folded condition of FIG. 4B, it has the foldable structure so as to select the use and non-use of the supporter for shoulder.

Furthermore, as continuously shown in one-dot chain line circles at low part of FIG. 4A, the supporter for arm 20 is preferably connected to the supporter 10A of the supporter for shoulder through a forward-rearward direction rotation second connection shaft 23, so that the conversion of the direction from forward to lateral is possible so as to be able to select the form of use in various ways.

The first and second connection shafts 21, 23 can be constructed together or separately, and the degree of conversion of each direction can be constructed to be stopped through various fixing means.

In addition, as continuously shown in one-dot chain line circles at low part of FIG. 4B, the supporter for armpit 10B of the supporter for shoulder 10 is preferably foldable by being connected to the supporter 10A through a rotation shaft 17.

In the relevant drawing, the rotation shaft 17 is structured to have a structure of combined use with the first connection shaft 21, and have a structure in which the portion of the supporter for shoulder 10 above the supporter for arm 20 is folded through the structure in which not only the supporter for armpit 10B is simply folded but also the supporter, in particular the upper first supporter S1 is folded.

Accordingly, in case of folding the supporter for shoulder (in particular, the supporter for armpit) with the rotation shaft 17 as the center so as to be superposed on the supporter for arm 20, additionally making the supporter for arm 20 to be directed forward through the second connection shaft 23 in this condition, and making the wing 10W of the cushion body 10C of the supporter for armpit also to be housed into the space 10S, the supporter for armpit 10B and the supporter for arm 20 which are superposed become the same structure so that the present chair equipped with supporter for shoulder C can be used like the conventional chair so that the convenience is maximized and the multi-purpose use is possible.

Although the principle of adjusting the height of the main supporter of the chair or the conventional known technology related to the other various kinds of chairs are omitted in the above description, those skilled in the art can easily suppose and reason this.

In addition, although the present invention has been described mainly about the chair having the specific shape and structure with reference to the accompanying drawings in the above description, the present invention can be variously amended, changed and replaced by those skilled in the art, and those amendment, change and replacement shall be interpreted to belong to the scope of protection of the present invention.

What is claimed is:

1. A chair comprising:

a base;

a hip supporter provided above the base;

a shoulder supporter comprising a vertical supporter connected to the base and protruding to both sides of the hip supporter, and an armpit supporter provided above the vertical supporter;

an arm supporter connected to the vertical supporter through a first rotational shaft and provided below the armpit supporter, the first rotational shaft being configured to be rotated in a forward-rearward direction such that a direction of the arm supporter can be freely changed between a forward direction and a lateral direction;

a horizontal link provided between the base and the vertical supporter, the horizontal link comprising a first link connected to the base, and a second link, the second link being slidably inserted into the first link and so fixed by a fixing handle as to adjust a length of the horizontal link as desired; and an elastic link provided between the vertical supporter and the second link, the elastic link being so configured to allow an free forward-rearward movement but restrain a left-right movement.

2. The chair of claim 1, wherein the arm supporter is connected to the vertical supporter through a second rotational shaft so as to be foldable in an up-down direction.

3. The chair of claim 2, wherein the armpit supporter is connected to the vertical supporter through a third rotational shaft so as to be foldable.

4. The chair of claim 1, wherein the armpit supporter is connected to the vertical supporter through a third rotational shaft so as to be foldable.

* * * * *